US005433062A

United States Patent [19]

Focke

[11] Patent Number: 5,433,062

[45] Date of Patent: Jul. 18, 1995

[54] PACKAGING CONTAINER (DISPLAY PACK) AND PROCESS AND APPARATUS FOR PRODUCING IT

[75] Inventor: Heinz Focke, Verden, Germany

[73] Assignee: Focke & Co. (GmbH & Co.), Verden, Germany

[21] Appl. No.: 284,971

[22] Filed: Aug. 4, 1994

Related U.S. Application Data

[62] Division of Ser. No. 866,520, Apr. 10, 1992, abandoned.

[30] Foreign Application Priority Data

Apr. 11, 1991 [DE] Germany ..... 41 11 787.5

[51] Int. Cl.[6] ..... B65B 5/08; B65B 7/28

[52] U.S. Cl. ..... 53/462; 53/207; 53/284.5; 53/448; 53/489

[58] Field of Search ..... 53/462, 207, 489, 485, 53/458, 457, 447, 448, 284.5, 284, 287, 564

[56] References Cited

U.S. PATENT DOCUMENTS

| | | | |
|---|---|---|---|
| 2,073,272 | 3/1937 | Wellman | 229/23 R X |
| 2,880,866 | 4/1959 | Van Dyck | 229/23 BT |
| 2,907,509 | 10/1959 | Chamberlin | 229/23 R X |
| 3,767,109 | 10/1973 | Paige | 229/23 BT X |
| 3,872,650 | 3/1975 | Vickers | 53/207 |
| 3,931,923 | 1/1976 | Thurston | 229/23 R |
| 3,934,720 | 1/1976 | Kratochvil, Jr. | 229/23 BT X |
| 4,674,261 | 6/1987 | Sabel | 53/207 X |
| 4,848,651 | 7/1989 | Hartness | 229/23 BT X |
| 4,976,394 | 12/1990 | Rathbone | 229/23 BT |
| 5,090,178 | 2/1992 | Ricchio | 53/489 X |
| 5,323,896 | 6/1994 | Jones | 53/462 X |

FOREIGN PATENT DOCUMENTS

| | | | |
|---|---|---|---|
| 2629051 | 9/1989 | France . | |
| 6920647 | 5/1969 | Germany . | |
| 3929142 | 3/1991 | Germany . | |
| 36-6373 | 4/1961 | Japan . | |
| 49-36605 | 10/1974 | Japan . | |
| 56-12182 | 3/1981 | Japan . | |
| 61-203317 | 9/1986 | Japan . | |
| 5170221 | 7/1993 | Japan | 53/462 |
| 2146310 | 4/1985 | United Kingdom . | |

*Primary Examiner*—James F. Coan

*Attorney, Agent, or Firm*—Sughrue, Mion, Zinn, Macpeak & Seas

[57] ABSTRACT

In order to protect the pack content of a packaging container during transport and storage, there is arranged in the region of the open side (20) of the packaging container (10) a cover cap (21). This consists of a covering wall (22) and of longitudinal insertion tabs (23) and transverse insertion tabs (24). The latter are fixed in a gap (25) between the pack content and the side walls (12 to 15). In the production of the packaging container (10), the cover cap (21) and a group of small packs (11) are pushed into the packaging container (10) jointly by way of the open bottom side of the latter. At the same time, an automatic folding of the insertion tabs (23, 24) of the cover cap (21) into the position appropriate to the pack takes place.

6 Claims, 7 Drawing Sheets

PACKAGING CONTAINER (DISPLAY PACK) AND PROCESS AND APPARATUS FOR PRODUCING IT

This is a divisional of Application Ser. No. 07/866,520, filed Apr. 10, 1992, now abandoned.

BACKGROUND OF THE INVENTION

The invention relates to a packaging container for the reception and presentation of a group of articles, especially small packs (display pack) consisting of relatively rigid packaging material, especially corrugated cardboard, having a bottom wall formed from folding tabs (bottom tabs) and side walls adjoining this and extending all around. The invention relates, furthermore, to a process for producing and filling a packaging container of this type. The invention finally relates to an apparatus for producing display packs.

The present packaging containers, also called a display pack, have a double function. On the one hand, they serve for the packaging of small packs, such as roasted-coffee packs etc., during transport and storage. On the other hand, the packaging containers are to be so designed that they can present (display) the articles or small packs for sale to the final consumer.

For the abovementioned purpose, the packaging containers are open on one side, namely at the top. Access to the pack content, for example to the small packs, is thereby possible. But a disadvantage of this type of pack is that the pack content is exposed in the region of the open side of the packaging container during transport and storage.

SUMMARY OF THE INVENTION

The object on which the invention is based is to provide a packaging container of the type described in the introduction, which on the one hand allows a presentation (display) of the pack content for the sale thereof, but on the other hand guarantees better protection of the pack content during transport and storage.

To achieve this object, the packaging container according to the invention is characterised by a covering (cover cap) closing an open (upper) side and consisting of a separate blank having a covering wall and lateral insertion tabs which project at least partially into the packaging container and which extend between the pack content (group of small packs) of the latter and the side walls.

The cover cap according to the invention sits loosely in the (upper) orifice of the packaging container or is at most connected to this by means of easily releasable spot-like adhesive bonds. The pack content is thereby also protected on the open side before the packaging container is used. For the presentation (display) of the pack content, the cover cap is removed by hand without difficulty, with the result that the packaging container is open on the upper side.

According to the invention, the cover cap can be designed in various ways, for example consisting of (corrugated) cardboard. The lateral insertion tabs of the cover cap can be connected to one another in the region of the corners. In this case, the cover cap is designed as a tray. It can be lifted off from the packaging container in the way described. But it is also possible, according to the invention, to set up the container with its open sides downwards and to use the cover cap designed as a tray for the presentation of the pack content.

Alternatively, the cover cap can consist of thin packaging material, for example paper.

For the production and filling of a packaging container according to the invention, the latter is erected, with the bottom wall, that is to say bottom tabs extending in the planes of the side walls, open. The pack content, especially a group of small packs, together with a blank for forming the cover cap is pushed into the packaging container by way of the side of the subsequent bottom wall, the insertion tabs of the cover cap being folded by a dimensionally stable mouthpiece during entry into the packaging container or beforehand.

Further features of the invention relate to the design of the packaging container and of the cover cap, to the production process and to an apparatus for this.

Exemplary embodiments of the packaging container and details of the production process and of an apparatus are explained in more detail below by means of the drawings. In these:

DESCRIPTION OF PREFERRED EMBODIMENTS

FIGS. 1 to 8 show different versions of a packaging container 10 which serves for receiving a group of cuboid small packs 11. These can be roasted-coffee packs. The packaging container 10 consists of relatively rigid packaging material, especially corrugated cardboard.

Figure 2:
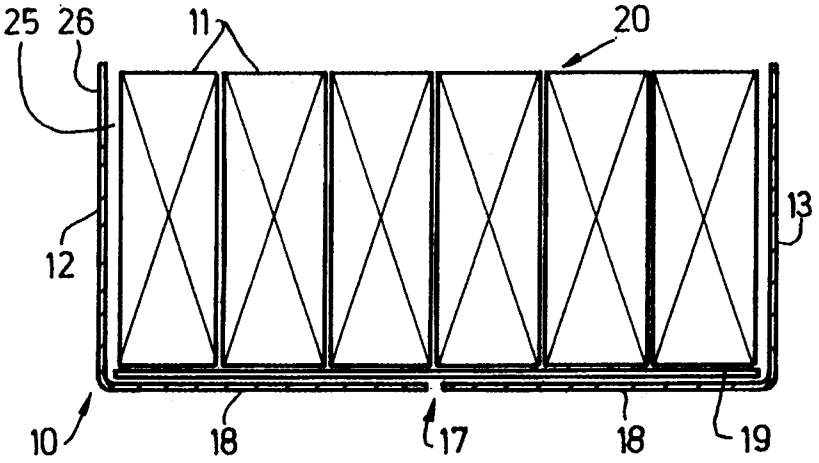
FIG. 2 shows the packaging container according to FIG. 1 in the state of use after the removal of the cover cap.
Figure 1:
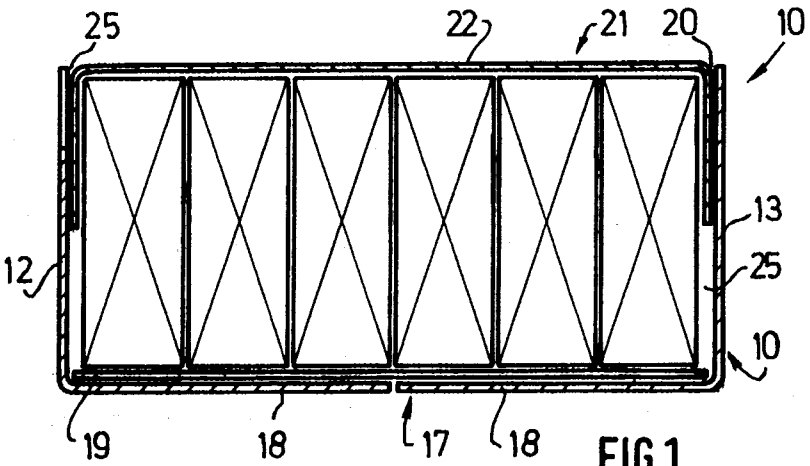
FIG. 1 shows a vertical section of a packaging container having a cover cap.
Figure 4:
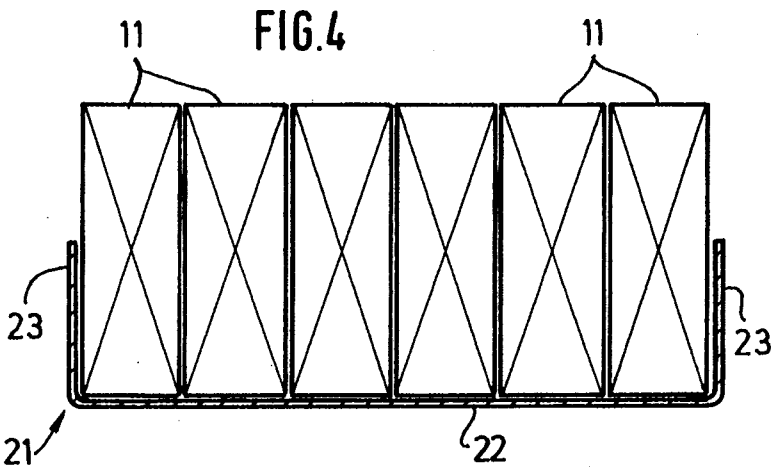
FIG. 4 shows the position of use of the packaging container according to FIG. 3.
Figure 3:
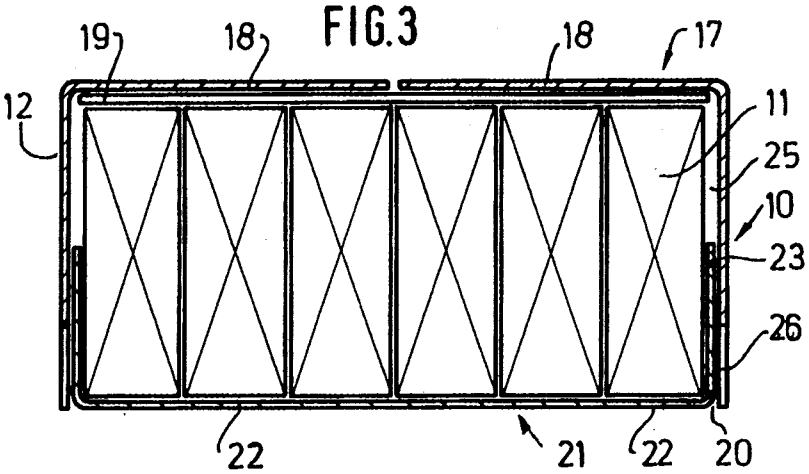
FIG. 3 shows another exemplary embodiment of a packaging container in a vertical section corresponding to that of FIG. 1.
Figure 5:
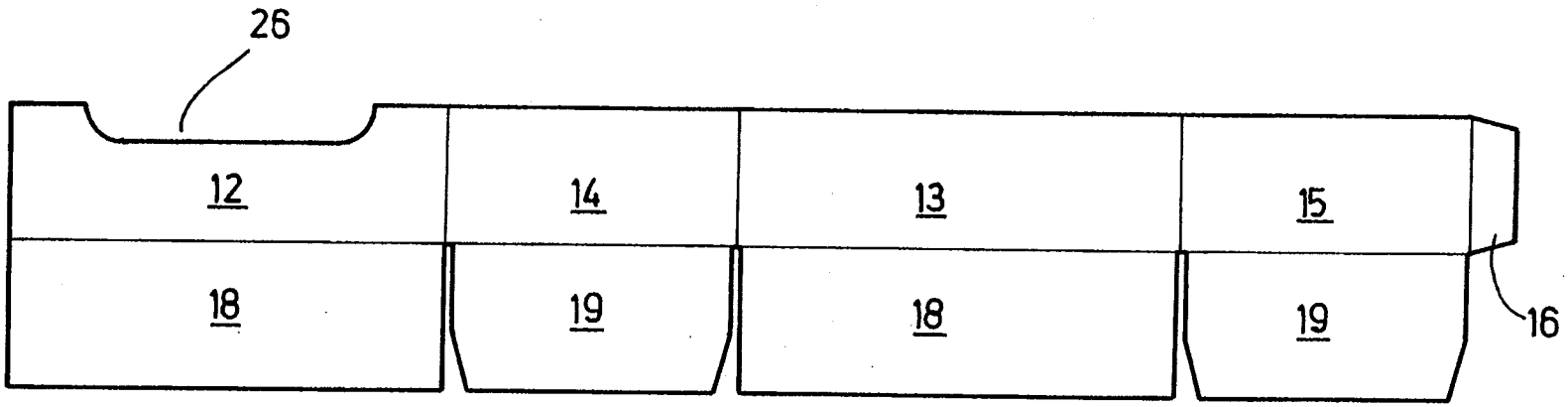
FIG. 5 shows a spread-out blank for a packaging container according to FIG. 1 or FIG. 3, FIG. 6 to FIG. 8 show blanks for different versions of a cover cap.

The packaging container 10 consists, here, of a one-piece blank (FIG. 5). Regions for forming side walls, namely longitudinal side walls 12, 13 and transverse side walls 14 and 15, are connected to one another in succession to form a strip-shaped blank. A connecting tab 16 is attached to a free edge of the transverse side wall 15. When the blank is folded to form a sleeve-shaped structure, having mutually opposed longitudinal side walls 12, 13 and transverse side walls 14, 15, the connecting tab 16 is connected to the free edge of the longitudinal side wall 12 by adhesive bonding or the like.

Folding tabs are attached to one side of the respective side walls 12 to 15 in order to form a bottom wall 17 of the packaging container 10. Provided correspondingly to the side walls 12 to 15 and located opposite one another in pairs are longitudinal bottom folding tabs 18 and transverse bottom folding tabs 19. In the present case, these are folded with a mutual overlap in such a way that the longitudinal bottom folding tabs 18 are located on the outside, and are connected to one another by adhesive bonding.

A packaging container 10 having an open side 20 which usually faces upwards is thus obtained. As is evident especially from FIG. 2, the small packs 11 can be extracted by way of the open side 20.

The packaging container 10 includes a covering in the region of the open side 20. This is a cover cap 21. The latter extends within the open side 20 of the packaging container 10, so that this is completely closed. The packaging container 10 and the cover cap 21 define a packaging unit.

The cover cap 21 consists of a covering wall 22 corresponding to the inner dimensions of the packaging container 10 in the region of the open side 20. Attached all-round to the edges of the covering wall 22 are insertion tabs, specifically longitudinal insertion tabs 23 and transverse insertion tabs 24 located opposite one another. The insertion tabs 23, 24 are folded into a position transverse to the plane of the covering wall 22 and are introduced into a gap 25 between the side walls 12 to 15, on the one hand, and the pack content, namely the small packs 11, on the other hand.

The insertion tabs 23, 24 are therefore fixed between the pack content and the side walls 12 to 15 of the packaging container 10 with a certain clamping force. In addition, the insertion tabs 23, 24 can be connected to the side walls 12 to 15 by means of an easily releasable adhesive bond (glue spots). In any event, the cover cap 21 so designed and arranged is to be easily removable. For this purpose, at least one side wall, in the present case the longitudinal side wall 12, is provided with a recess 26. This makes it possible to grasp the cover cap 21 by hand.

In the exemplary embodiments shown, the dimensions of the packaging container 10 and of the cover cap 21 as well as of the pack content are so coordinated with one another that the cover cap 21 rests with the covering wall 22 on the top side of the small packs 11. By means of corresponding dimensions, the covering wall 22 terminates flush with the upper free edges of the side walls 12 to 15. The insertion tabs 23, 24 extend approximately over half the height of the side walls 12 to 15.

The cover cap 21 can be designed in various ways. According to FIG. 6, the cover cap 21 likewise consists of relatively rigid (corrugated) cardboard. The longitudinal insertion tabs 23 and transverse insertion tabs 24 are not connected to one another at the corners of the covering wall 22, but penetrate freely into the gap 25.

Figure 7:
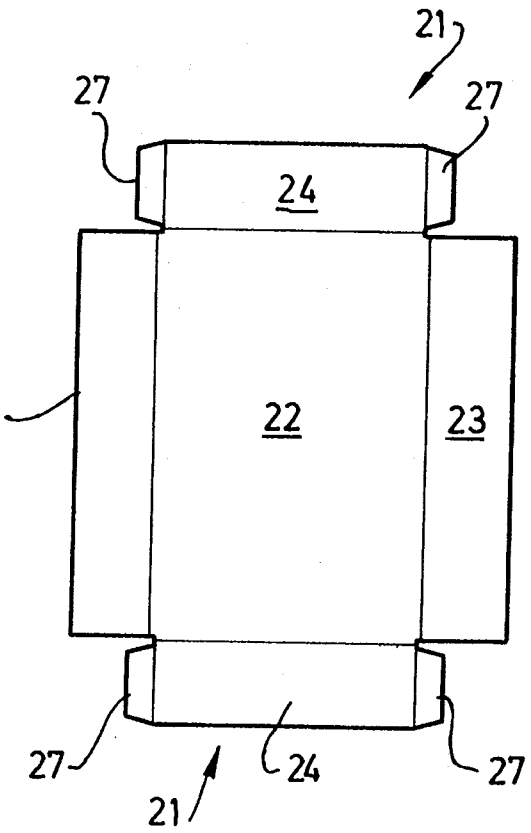
Figure 6:
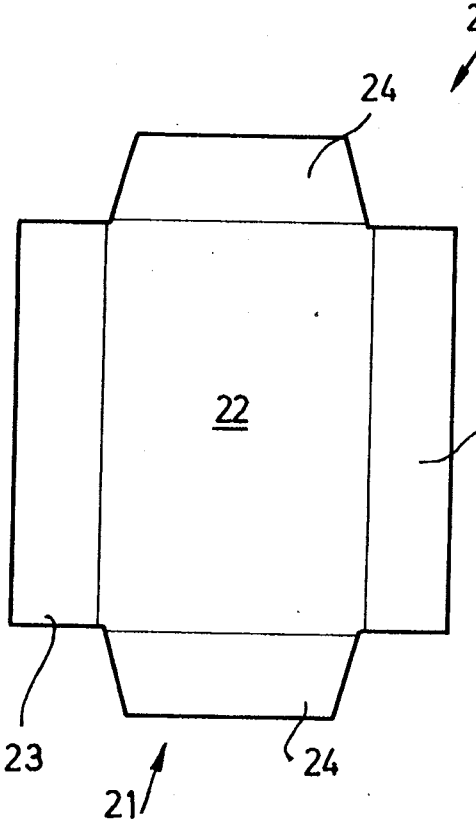

In the cover cap according to FIG. 7, the longitudinal insertion tabs 23, on the one hand, and the transverse insertion tabs 24, on the other hand, are connected to one another in the folded-up position. Attached for this purpose to the free sides of the transverse insertion tabs 24 are adhesive tabs 27. With the cover cap 21 ready-folded, these are connected to the facing edges of the longitudinal insertion tabs 23 by adhesive bonding. A closed dimensionally stable cover cap 21 is thereby obtained.

This can itself be used as a functional display pack, specifically as a tray. In this type of pack (FIG. 4), the insertion tabs 23, 24 (rims) have a clearly smaller height than the pack content (small packs 11). The packaging container 10 according to FIG. 3 and FIG. 4 permits this type of presentation of the small packs 11, in that the packaging container 10, when put to use, is set up with a cover cap 21 directed downwards and the actual packaging container 10 is lifted off from the cover cap 21 and the small packs 11.

Figure 8:
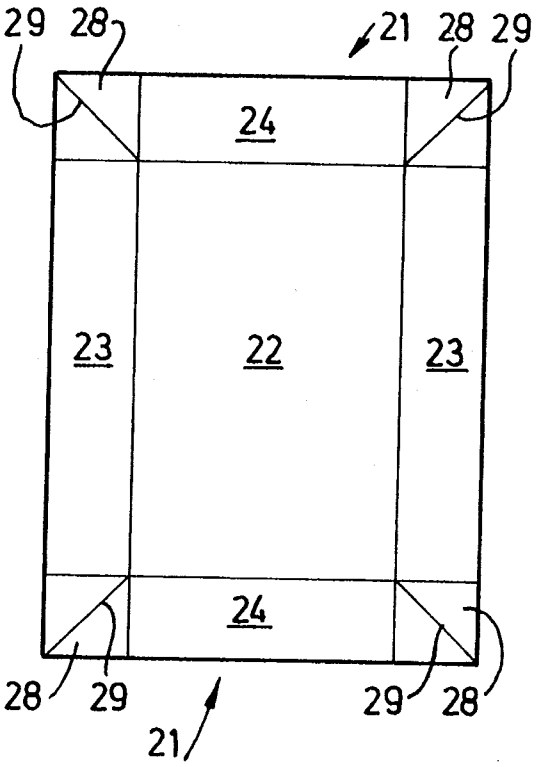

A cost-effective version of a cover cap 21 is shown as a blank in FIG. 8. This consists of very thin packaging material, especially paper. In this exemplary embodiment, the insertion tabs 23, 24 are connected to one another by means of corner tabs 28. These corner tabs 28 are folded along a diagonal folding line 29 during the production of the cover cap 21. Thereby obtained in the region of the corners are triangular double-ply gussets. These are folded round against the longitudinal insertion tab 23 or against the transverse insertion tab 24. A connection of the corner tabs 28 by adhesive bonding is advantageous for stabilising the shape of the cover cap 21 made of thin packaging material.

A packaging container of the type described can be produced and filled in a simple way. For this purpose, first an intermediate folding position of the packaging container 10 is formed from the blank according to FIG. 5, specifically merely by adhesively bonding the connecting tab 16 to the longitudinal side wall 12. A sleeve-like structure of rectangular cross-section is thereby obtained (on the left in FIG. 9). In this position, the longitudinal bottom tabs 18 and transverse bottom tabs 19 extend in the plane of the side walls 12 to 15 or are made slightly funnel-shaped towards the outside.

Figure 9:
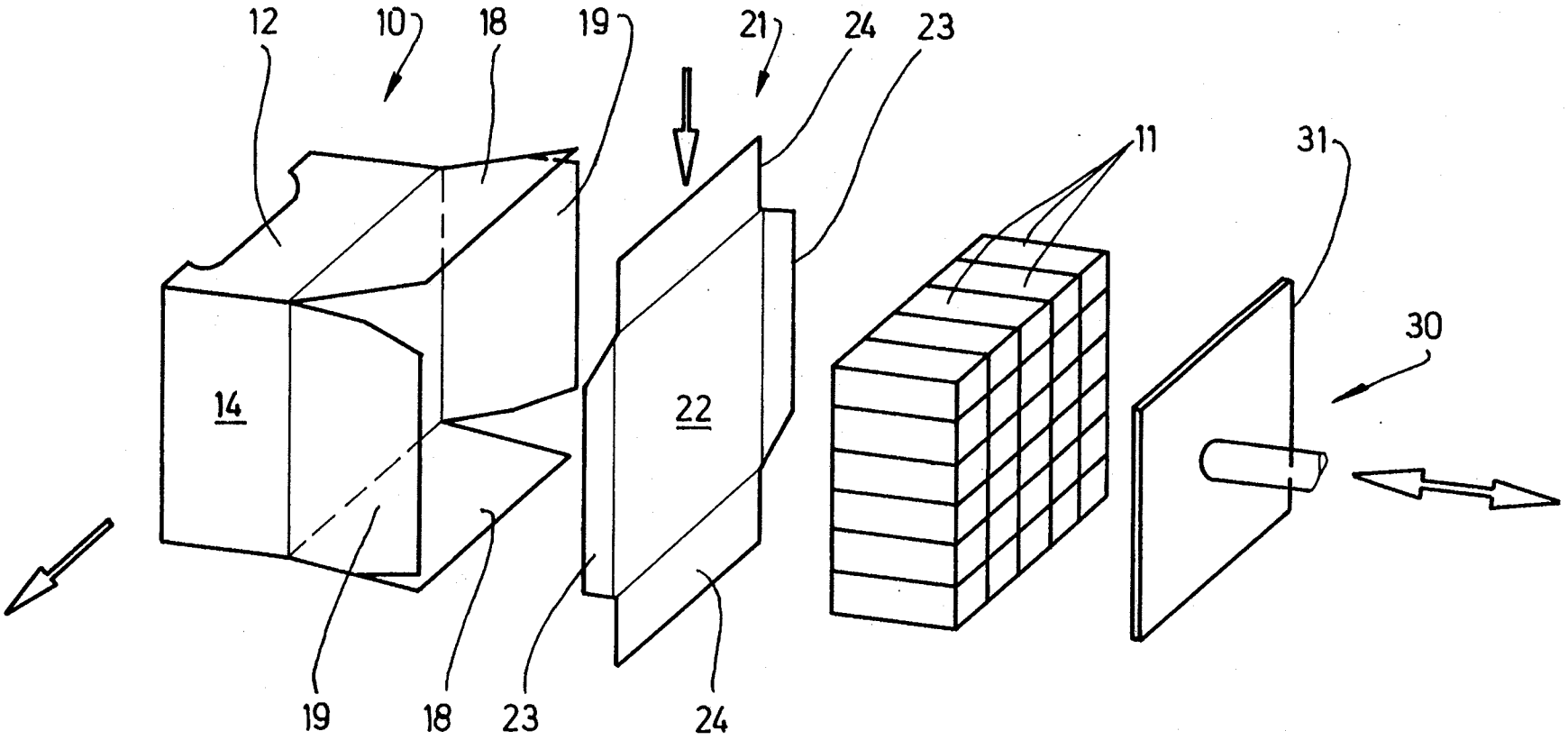
FIG. 9 shows a perspective representation of the filling and completion of a packaging container corresponding to that of FIG. 1.

The packaging container 10 thus prepared is then filled from the bottom side. The blank for the cover cap 21 is introduced together with the pack content, namely a group of small packs 11, into the packaging container 10 simultaneously and Jointly by way of the bottom side as far as the end position. For this purpose, the non-folded extended blank for the cover cap 21 is arranged, in the conveying direction, in front of the small packs 11 formed according to the content of the packaging container 10. The group of small packs 11 is transported in the horizontal direction by a slide 30 having a large-surface slide plate 31. The blank for the cover cap 21, which here has been conveyed from above into the position shown in FIG. 9, is taken up by the group of small packs 11. The cover cap 21 and the group of small packs 11 are then pushed Jointly into the packaging container 10 open on the bottom side, specifically in the horizontal direction. At the same time, the insertion tabs 23, 24 of the cover cap 21 are automatically folded into the desired position, coming to bear against the group of small packs 11.

The folding operation for the insertion tabs 23, 24 can be made easier or assisted by folding members. In front of the entry into the packaging container 10 can be arranged a folding mouthpiece 32 which corresponds in dimensions to the contour of the cover cap 21 in the end position. When the blank for the cover cap 21 is pushed through by this folding mouthpiece 32, the insertion tabs 23, 24 are folded until they come to bear against the group of small packs 11. The folding mouthpiece 32 can consist of a closed frame extending all-round.

After the packaging container 10 has been filled in the way described, the bottom tabs 18, 19 are folded into the position for forming the bottom wall 17.

Figure 10:
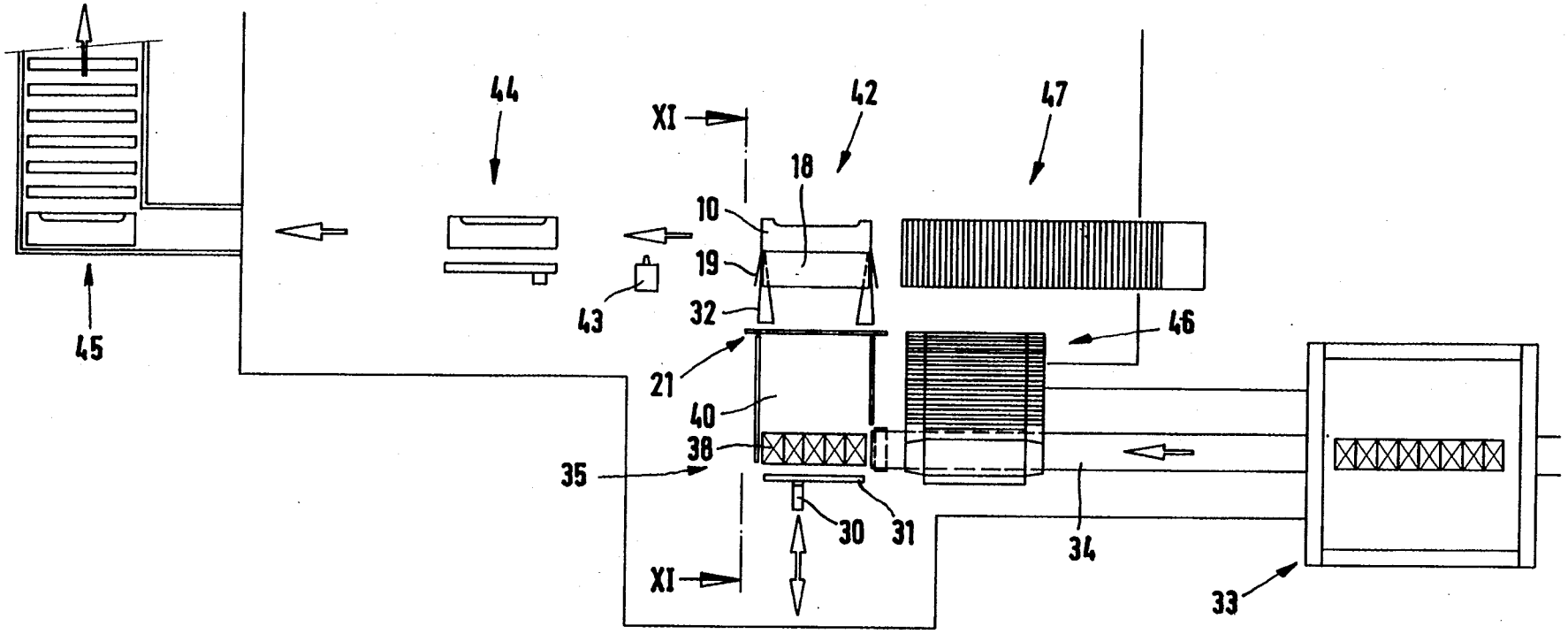
FIG. 10 shows a diagrammatic plan view of an apparatus for producing packaging containers.
Figure 11:
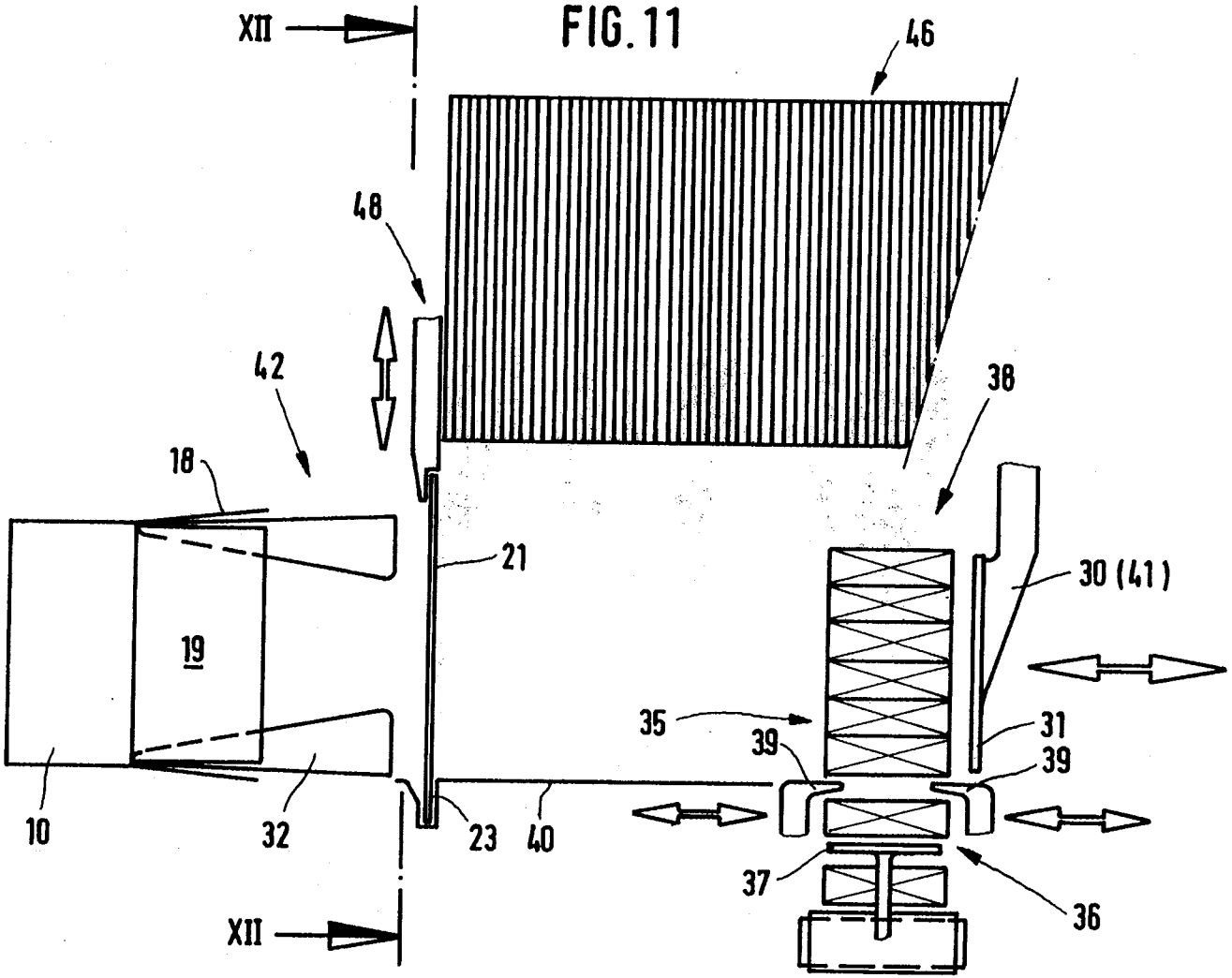
FIG. 11 shows a view of the apparatus in the plane XI—XI of FIG. 10 (elevation)
Figure 12:
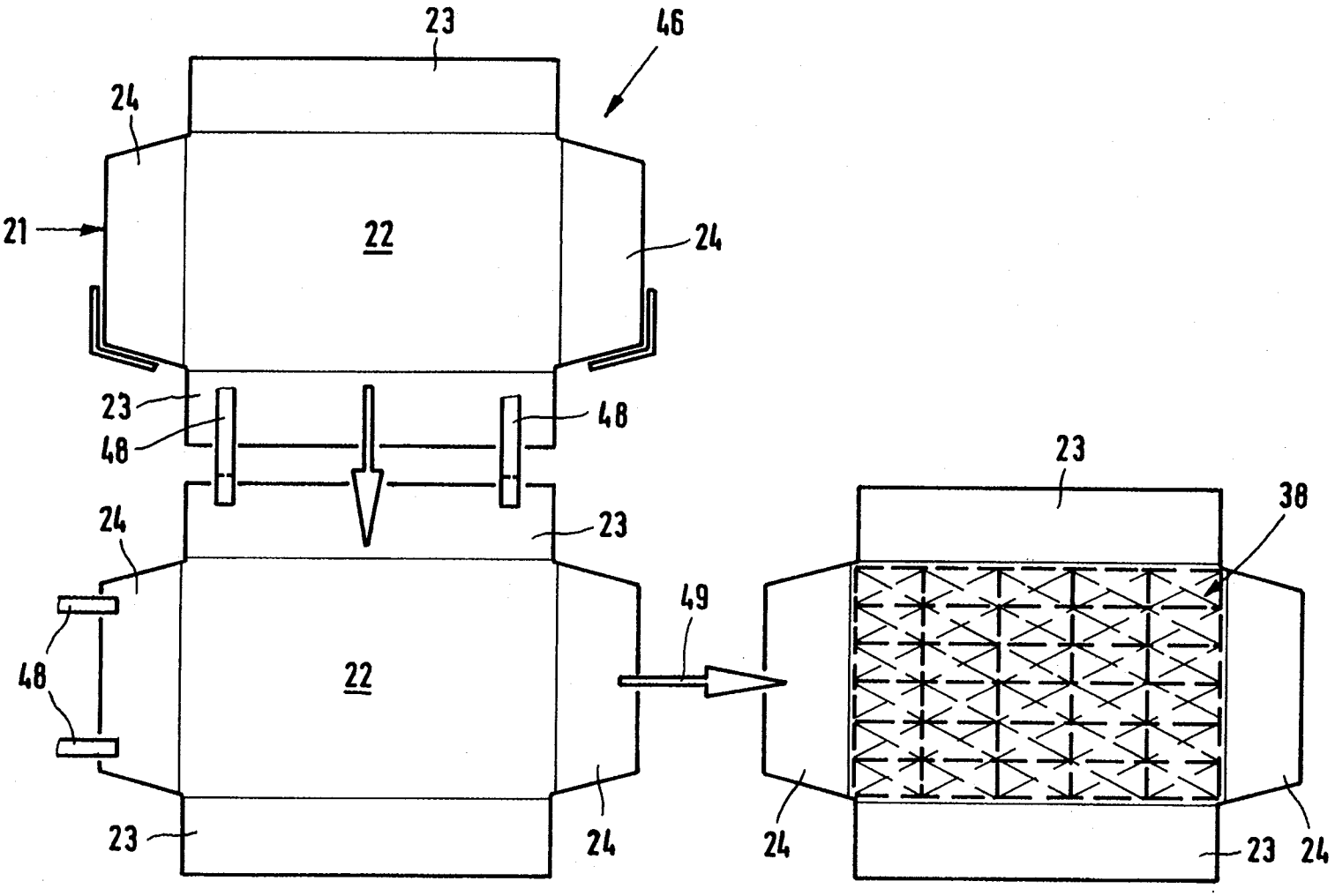
FIG. 12 shows a side view of the detail according to FIG. 11 in the plane XII—XII.

An exemplary apparatus for producing packs of the type described is shown in FIGS. 10 to 12. The small packs 11 are extracted from a pack store 33 of known design and fed on a feed conveyor 34 to a stacking station 35. Here, layers of small packs 11 are stacked above one another. For this purpose, according to FIG. 11, pack layers 36 are conveyed onto a lifting ram 37 in succession. As a result of an upward movement of the latter, the pack layers 36 are fed successively from below to a pack group 38. After completion, this is at the same time the content of a packaging container 10. The pack group 38 or a part group is supported in a known way during the stacking operation by laterally movable holding tongues 39.

The complete pack group 38 is fed on a support, namely a track plate 40, by the slide 30 to a filling station 42. In the region of this, a blank for the cover cap 21 is held ready in a plane transverse relative to the direction of movement of the pack group 38. The further filling and folding operation then takes place in the way described in conjunction with FIG. 9.

The filled packaging container 10, still open in the region of the bottom, is then first guided past a glue-coating member 43 in the transverse direction. Here, glue spots are applied to the bottom tabs 18, 19 by nozzles. In a folding station 44, the bottom tabs 18 and 19 are subsequently folded to form the bottom wall 17. The finished packaging container 10 then passes on to a discharge-conveyor track 45. The filling station 42 is assigned two blank magazines 46 and 47. The first mentioned blank magazine 46 receives the blanks for the cover cap 21, in the present case in the version according to FIG. 6. This blank magazine 46 is located above the filling station 42, specifically in the region of the feed conveyor 34. As is evident from FIG. 12, the blanks extracted from the blank magazine 46 are first moved downwards by means of corresponding blank conveyors 48. In an intermediate position, the blanks are arranged level with the filling station 42, but in such a way that the downwardly directed longitudinal insertion tab 23 lies below the plane of the track plate 40. The lowered blank is now displaced in the transverse direction according to arrow 49 into the position according to FIG. 9 or according to FIG. 11. The filling operation described can now proceed.

The blank magazine 47 serves for receiving and delivering the blanks for the packaging container 10. These are finished pack sleeves folded together flat. They are erected in the region of the filling station 42 into a three-dimensional shape according to FIG. 9 on the left. Cardboard erectors of known design are used for this. The prepared blank is aligned with the folding mouthpiece 32. The pack content can now be pushed in.

What is claimed is:

1. A process for the production and filling of a packaging container for the reception and presentation of a group of small packs (11), said packaging container (10) being made from a first blank consisting of relatively rigid packaging material and having a bottom wall (17) formed from folding bottom tabs (18, 19), side walls (12 to 15) adjoining the bottom wall and extending all around the packaging container, and a cover cap (21) closing an open upper side (20) of the package and consisting of a separate blank having a covering wall (22) and lateral insertion tabs (23, 24) which project at least partially into the packaging container (10) and which extend between the group of small packs (11) and the side walls (12 to 15), said process comprising the following steps:

a) first, a sleeve-like structure of the packaging container (10) having an open bottom side and bottom tabs (18, 19) extending in the plane of the side walls (12 to 15) is formed from a strip-like first blank of the packaging container (10);

b) the unfolded separate blank for the cover cap (21) is positioned in front of the open bottom side of the packaging container (10) in such a manner that the covering wall (22) is brought into line with the open bottom side;

c) the group of small packs (11), on the side of the cover cap (21) confronting the packaging container (10), is positioned so as to be aligned with the covering wall (22) of the cover cap (21); and d) finally, the group of small packs (11 ) is pushed into the packaging container (10) by way of the open bottom side by a slide (30) thereby taking along the cover cap (21), and, during the pushing-in, the insertion tabs (23, 24) projecting beyond the group of small packs (11) are folded into a position appropriate to the pack, and a unit consisting of the cover cap (21) and group of small packs is displaced as far as an end position within the packaging container (10).

2. The process according to claim 1, wherein the separate blank for the cover cap (21), before entering the packaging container (10), is conveyed through a separate folding member (32) by the slide (30) together with the group of small packs (11), and the insertion tabs (23, 24) of the cover cap (21) are thereby folded until they abut the group of small packs (11).

3. An apparatus for the production and filling of a packaging container for the reception and presentation of a group of small packs (11), said packaging container (10) being made from a first blank consisting of relatively rigid packaging material and having a bottom wall (17) formed from folding bottom tabs (18, 19), side walls (12 to 15) adjoining the bottom wall and extending all around the packaging container, and a cover cap (21) closing an open side (20) of the package and consisting of a separate blank having a covering wall (22) and lateral insertion tabs (23, 24) which project at least partially into the packaging container (10) and which extend between the group of small packs (11) and the side walls (12 to 15), said apparatus comprising: a filling station (42); a first blank magazine (46) for storing the separate blank of the cover cap (21); a second blank magazine (47) for storing the first blank of the packaging container (10) in an intermediate folding position as a sleeve-like structure, said first and second blank magazines being assigned to a filling station (42), the first blank magazine (46) being arranged above and laterally offset from the filling station (42); means for extracting the separate blank from the first blank magazine (46); and means for moving the extracted blank first downwards and then in a transverse direction into the filling station (42).

4. The apparatus according to claim 3, comprising a slide (30) with a large slide plate (31) by means of which the group of small packs (11) is, jointly and simultaneously with the cover cap (21), pushed into the packaging container (10).

5. The apparatus according to claim 3, comprising a separate folding member (32) for folding the insertion tabs (23, 24) of the cover cap (21), wherein said folding member (32), in its dimensions, corresponds to the shape of the cover cap (21) in the end position thereof within the packaging container, and is arranged before the packaging container (10) relative to the pushing-in direction of the group of small packs (11) with the cover cap (21).

6. The apparatus according to claim 4, comprising a separate folding member (32) for folding the insertion tabs (23, 24) of the cover cap (21), wherein said folding member (32), in its dimensions, corresponds to the shape of the cover cap (21) in the end position thereof within the packaging container, and is arranged before the packaging container (10) relative to the pushing-in direction of the group of small packs (11) with the cover cap (21).

* * * * *